US011965316B2

(12) United States Patent
McKinzie

(10) Patent No.: US 11,965,316 B2
(45) Date of Patent: Apr. 23, 2024

(54) WORK VEHICLE WITH AUXILIARY WORK TOOL AND METHOD OF CONTROLLING PROPULSION OF WORK VEHICLE HAVING AUXILIARY WORK TOOL

(71) Applicant: DEERE & COMPANY, Moline, IL (US)

(72) Inventor: Kyle K. McKinzie, Oswego, KS (US)

(73) Assignee: DEERE & COMPANY, Moline, IL (US)

( * ) Notice: Subject to any disclaimer, the term of this patent is extended or adjusted under 35 U.S.C. 154(b) by 450 days.

(21) Appl. No.: 17/301,896

(22) Filed: Apr. 19, 2021

(65) Prior Publication Data

US 2022/0333350 A1 Oct. 20, 2022

(51) Int. Cl.
*E02F 9/22* (2006.01)
*E02F 3/16* (2006.01)

(52) U.S. Cl.
CPC ..... *E02F 9/2246* (2013.01); *E02F 3/16* (2013.01)

(58) Field of Classification Search
CPC ..... E02F 9/2246; E02F 9/2253; E02F 5/06
See application file for complete search history.

(56) References Cited

U.S. PATENT DOCUMENTS

| | | | | |
|---|---|---|---|---|
| 9,464,580 | B2 * | 10/2016 | Aardema | F16H 61/4017 |
| 9,856,967 | B2 * | 1/2018 | Morselli | F16H 57/01 |
| 10,034,432 | B2 * | 7/2018 | Hoffmann | A01F 15/0833 |
| 10,779,475 | B2 * | 9/2020 | Rodewald | B60W 10/02 |
| 2012/0029775 | A1 * | 2/2012 | Peters | F15B 11/162 700/282 |

FOREIGN PATENT DOCUMENTS

DE 102005002880 A1 8/2006

OTHER PUBLICATIONS

German Search Report issued in application No. DE102022202166.5 dated Oct. 28, 2022 (10 pages).

* cited by examiner

*Primary Examiner* — Dalena Tran

(57) ABSTRACT

A work vehicle and a method of controlling propulsion of a work vehicle includes an auxiliary work tool. The method includes receiving a propulsion input for propelling the work vehicle at a propulsion speed, determining a prime mover speed for a prime mover configured to propel the work vehicle, propelling the work vehicle with a prime mover output based on the propulsion input, operating the auxiliary work tool while propelling the work vehicle, determining an auxiliary work tool load from operation of the auxiliary work tool, determining whether the auxiliary work tool load of the auxiliary work tool exceeds an auxiliary work tool load threshold, and reducing the propulsion speed of the work vehicle if the auxiliary work tool load of the auxiliary work tool exceeds the auxiliary work tool load threshold.

14 Claims, 3 Drawing Sheets

WORK VEHICLE WITH AUXILIARY WORK TOOL AND METHOD OF CONTROLLING PROPULSION OF WORK VEHICLE HAVING AUXILIARY WORK TOOL

BACKGROUND

Some work vehicles include one or more auxiliary work tool(s), such as a cutter on a trenching machine in non-limiting example, intended to work the ground under or near the work vehicle. Such auxiliary work tools may be subjected to an auxiliary work tool load that may be affected by the movement of the work vehicle. Additionally, the ground may vary in density or include load-increasing material such that the auxiliary work tool load may vary across the work area. Accordingly, the auxiliary work tool load may increase significantly as the work vehicle traverses over the work area.

SUMMARY

Various aspects of examples of the present disclosure are set out in the claims.

In an embodiment of the present disclose, a method of controlling propulsion of a work vehicle having an auxiliary work tool is provided. The method includes receiving a propulsion input for propelling the work vehicle at a propulsion speed determining a prime mover speed for a prime mover configured to propel the work vehicle, the prime mover providing a prime mover output based on the propulsion input, propelling the work vehicle with the prime mover output based on the propulsion input, operating the auxiliary work tool while propelling the work vehicle, determining an auxiliary work tool load from operation of the auxiliary work tool, determining whether the auxiliary work tool load of the auxiliary work tool exceeds an auxiliary work tool load threshold, wherein the auxiliary work tool load threshold is based on the prime mover speed, and reducing the propulsion speed of the work vehicle if the auxiliary work tool load of the auxiliary work tool exceeds the auxiliary work tool load threshold.

A method of one or more embodiments may further include receiving a propulsion speed limit input corresponding to a propulsion speed limit for propelling the work vehicle to a maximum propulsion speed, and determining the propulsion speed of the work vehicle, wherein the auxiliary work tool load threshold is based further on the propulsion speed limit input. A method may further include storing reference data for the auxiliary work tool load threshold based a plurality of prime mover speed values and determining the auxiliary work tool load threshold using the reference data. A method may further include determining the auxiliary work tool load comprises sensing a hydraulic pressure of a hydraulic circuit connected to the auxiliary work tool. The propulsion input may be based on an operator control input. A method may further include operating the auxiliary work tool while propelling the work vehicle comprises operating the auxiliary work tool to receive the auxiliary work tool load from working a ground under the work vehicle while propelling the work vehicle over the ground. A method may further include maintaining the prime mover speed of the prime mover if the auxiliary work tool load of the auxiliary work tool exceeds the auxiliary work tool load threshold.

In an embodiment of the present disclosure, a work vehicle includes a plurality of ground engaging members configured to propel the work vehicle at a propulsion speed, a prime mover configured to drive the plurality of ground engaging members based on a prime mover output, an auxiliary work tool receiving an auxiliary work tool load that is based on the propulsion speed of the work vehicle, a controller configured to receive a propulsion input for propelling the work vehicle via the plurality of ground engaging members at the propulsion speed, receive an auxiliary work tool load input based on the auxiliary work tool load, and reduce the propulsion speed of the work vehicle if the auxiliary work tool load input exceeds an auxiliary work tool load threshold.

The work vehicle may include an operator interface configured to generate an operator control input, wherein the controller may be further configured to receive a propulsion speed limit input based on the operator control input corresponding to a propulsion speed limit for propelling the work vehicle via the plurality of ground engaging members to a maximum propulsion speed, and determine the propulsion speed of the work vehicle, wherein the auxiliary work tool load threshold is based further on the propulsion speed limit input. The controller may be configured to receive a desired propulsion speed input for propelling the work vehicle via the plurality of ground engaging members at a desired propulsion speed, and reduce the propulsion speed of the work vehicle to a propulsion speed under the desired propulsion speed if the auxiliary work tool load input exceeds the auxiliary work tool load threshold. The work vehicle may further include a computer readable medium storing reference data associating the auxiliary work tool load threshold with a plurality of prime mover speed values, wherein the controller determines the auxiliary work tool load threshold using the reference data stored in the computer readable medium. The work vehicle may further include a hydraulic circuit connected to the auxiliary work tool, wherein the auxiliary work tool load is based on a hydraulic pressure of the hydraulic circuit. The propulsion input may be based on at least one operator control input. The auxiliary work tool may be configured to receive the auxiliary work tool load from working a ground under the work vehicle while propelling the work vehicle over the ground. The prime mover may include a prime mover speed, and wherein the auxiliary work tool load threshold is based on the prime mover speed. The controller may be further configured to maintain the prime mover speed of the prime mover if the auxiliary work tool load of the auxiliary work tool exceeds the auxiliary work tool load threshold.

The above and other features will become apparent from the following description and accompanying drawings.

BRIEF DESCRIPTION OF THE DRAWINGS

The detailed description of the drawings refers to the accompanying figures in which.

Like reference numerals are used to indicate like elements throughout the several figures.

DETAILED DESCRIPTION

Figure 1:
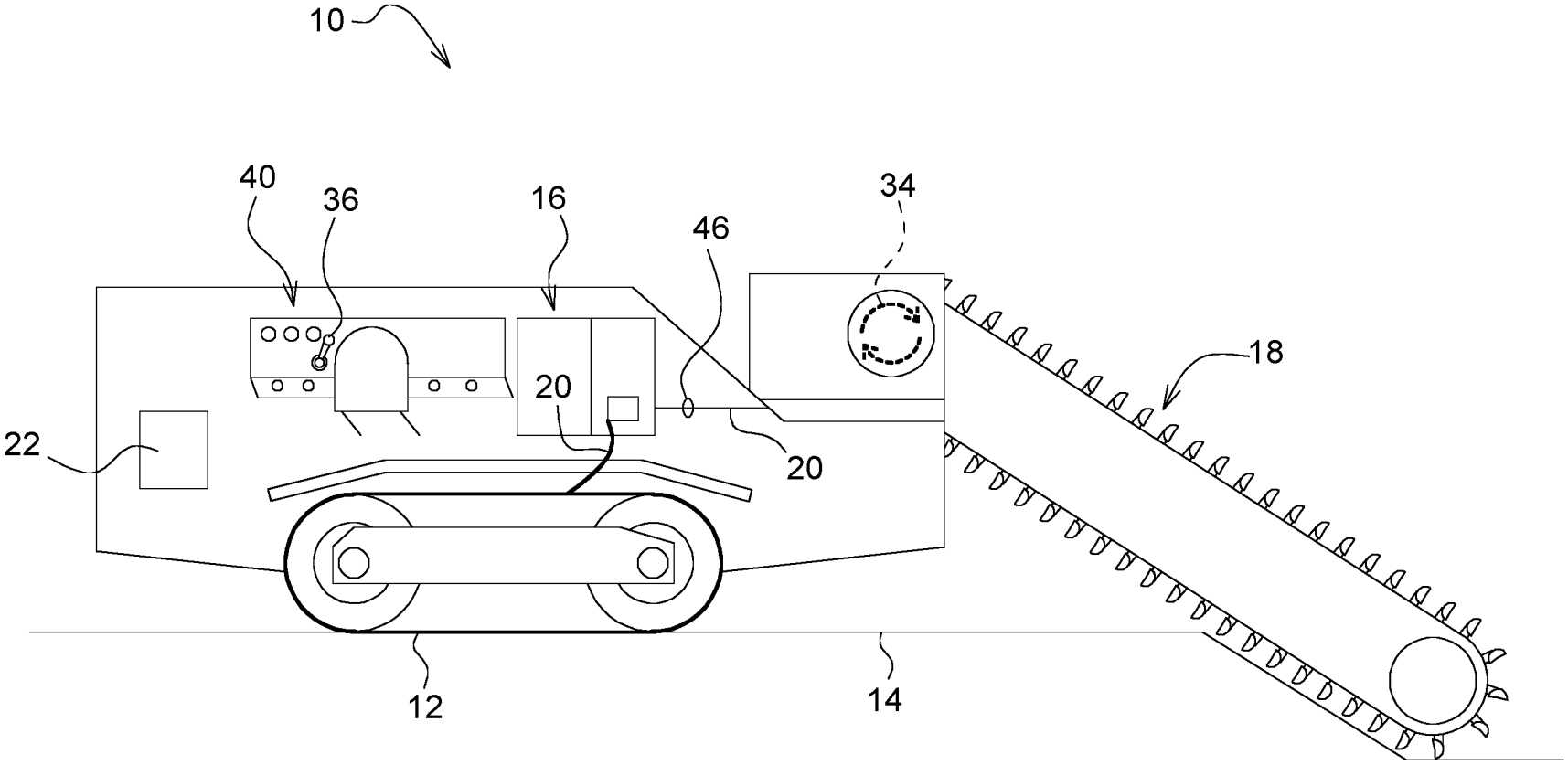
FIG. 1 illustrates a work vehicle in accordance with an embodiment of the present disclosure.
Figure 2:
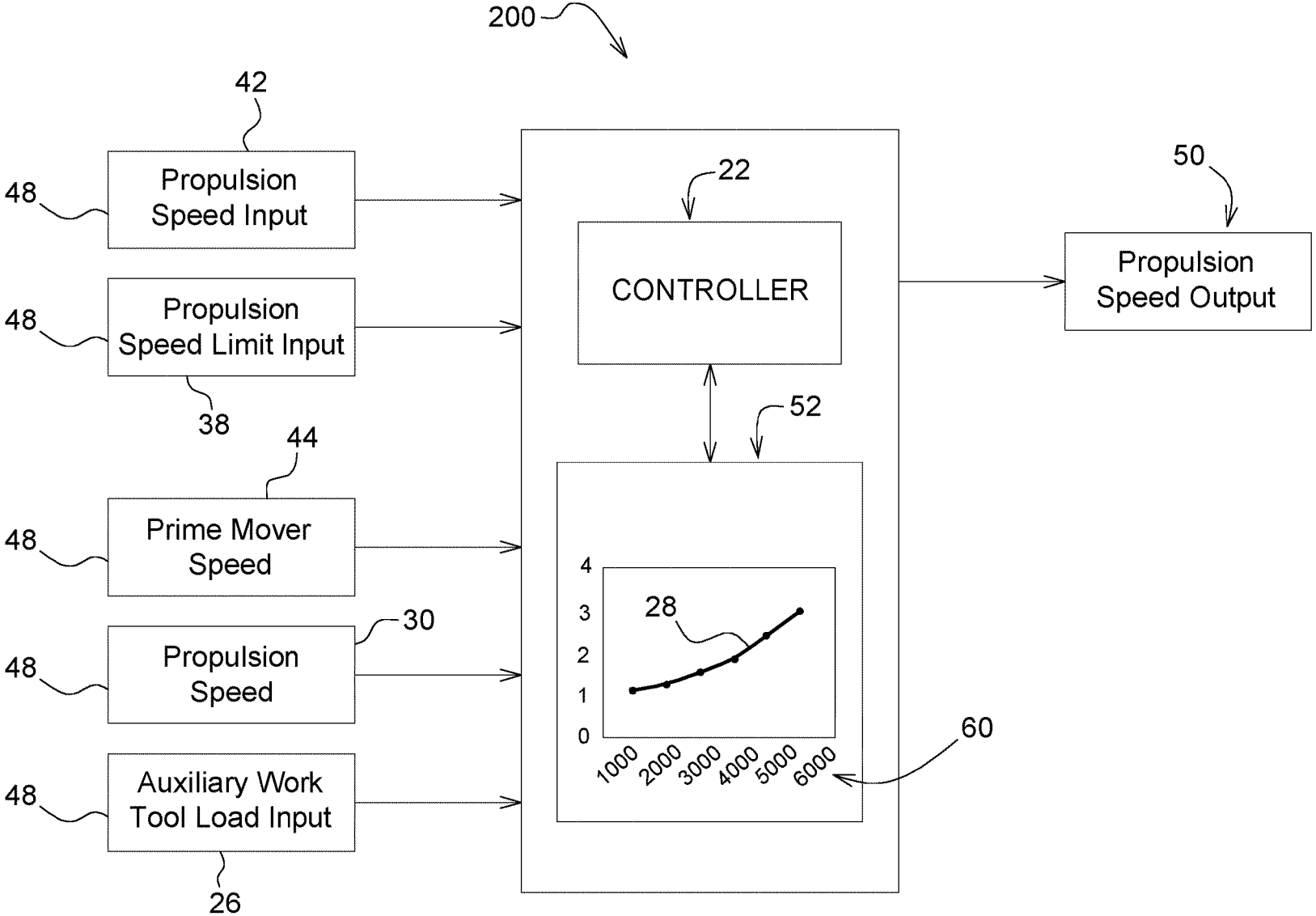
FIG. 2 illustrates a control system for a work vehicle in accordance with an embodiment of the present disclosure.
Figure 3:
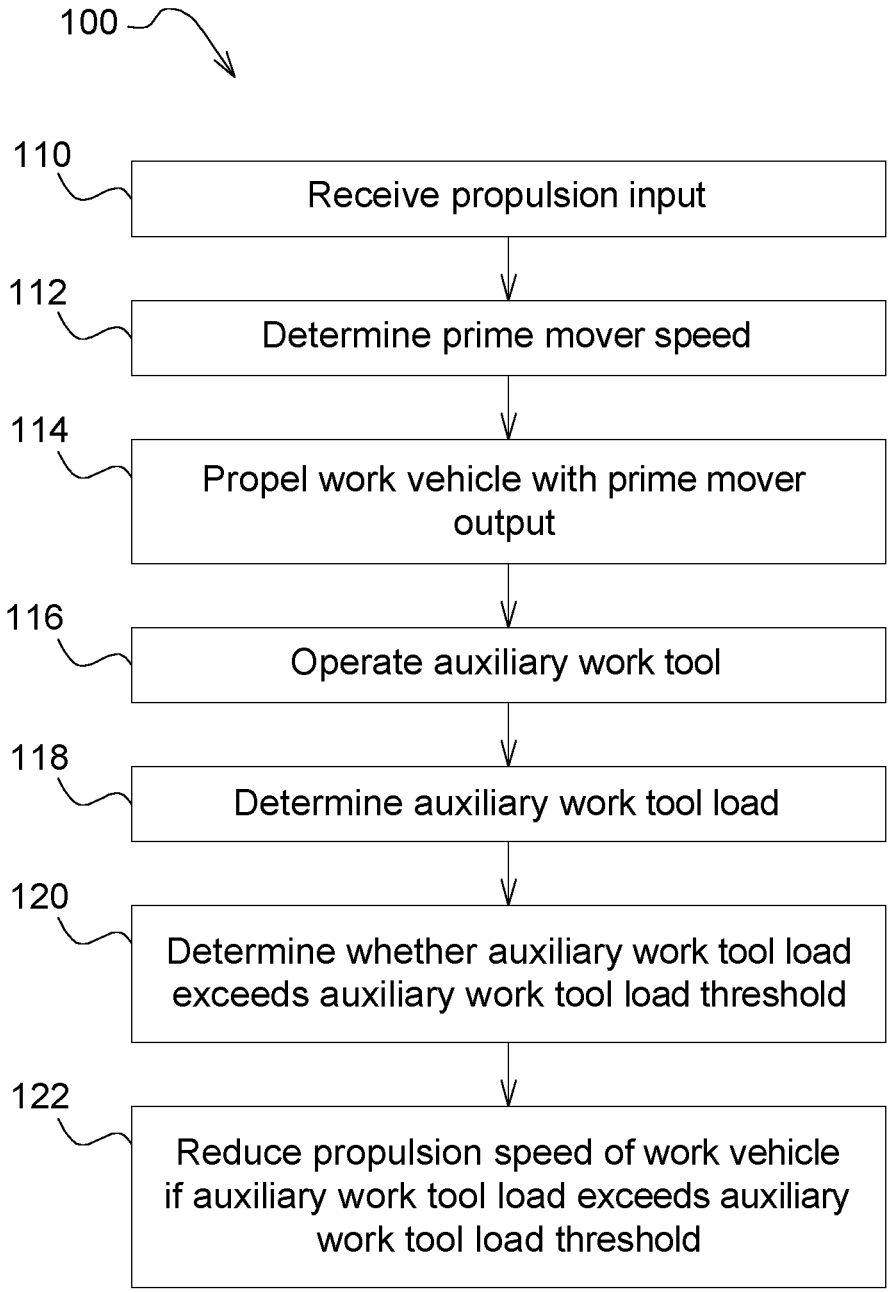
FIG. 3 illustrates a method of controlling propulsion of a work vehicle in accordance with an embodiment of the present disclosure.

At least one embodiment of the subject matter of this disclosure is understood by referring to FIGS. 1 through 3 of the drawings.

Reference is now made to FIG. 1, which illustrates a work vehicle 10 in accordance with an embodiment of the present disclosure. The work vehicle 10 in the illustrated embodiment includes ground engaging members 12, including wheels, tracks, and/or another structure capable of allowing or configured to propel the work vehicle 10 to move across a ground 14 at a propulsion speed 30.

The work vehicle 10 further includes a prime mover 16 configured to drive one or more of the ground engaging members 12 based on a prime mover output. The prime mover 16 of the illustrated embodiment is a diesel, gasoline, or other fuel internal combustion engine, but the prime mover 16 may include one or multiple electric machine(s), hydraulic, pneumatic or other motor(s), with or without a hydraulic, mechanical, or other transmission or circuit(s), and/or another component capable of driving and/or providing motive power to the one or more ground engaging members 12 to allow movement of the work vehicle 10.

The work vehicle 10 further includes an auxiliary work tool 18. The work vehicle 10 in the illustrated embodiment is a trenching machine, and the auxiliary work tool 18 is a cutter. In additional embodiments of the present disclosure not illustrated, the work vehicle 10 and/or the auxiliary work tool 18 is a tillage or cultivation attachment, implement, or equipment, grass, brush, tree, or crop cutting or mowing equipment, harvesting machine or equipment, and/or another earth-moving, construction, and/or agricultural vehicle, attachment, or implement.

Referring now to FIG. 2 with continuing reference to FIG. 1, a work vehicle control system 200 is illustrated for the work vehicle 10 having the auxiliary work tool 18 in accordance with embodiments of the present disclosure. The control system 200 forms part of any embodiment of the work vehicle 10 and/or methods described in the present disclosure, and vice versa. The control system 200 and the work vehicle 10 of one or more embodiments includes a controller 22 with one or more input(s) 48 and a propulsion speed output 50. As will be described in further detail below, the controller 22 communicates with one or more stored or accessible algorithm(s), programming or other code, and/or reference data in one or more memory circuit(s) 52 in order to determine and provide the propulsion speed output 50.

The auxiliary work tool 18 in the illustrated embodiment receives, includes, or is subject to an auxiliary work tool load 34, as indicated in FIG. 1. The auxiliary work tool load 34 is provided to the controller 22 via the auxiliary work tool load input 26. The auxiliary work tool load 34 in the illustrated embodiment is the load on the auxiliary work tool 18 as it cuts through the ground 14. The auxiliary work tool 18 of an embodiment is configured to receive the auxiliary work tool load 34 from working the ground 14 under the work vehicle 10 while propelling the work vehicle 10 over the ground 14. As the work vehicle 10 moves or travels across the ground 14, the auxiliary work tool load 34 of the auxiliary work tool 18 is based at least partially on the propulsion speed 30 of the work vehicle 10. As the propulsion speed 30 of the work vehicle 10 increases, the auxiliary work tool load 34 of the auxiliary work tool 18 increases in an embodiment as the auxiliary work tool 18 must work or cut through more of the ground 14 per unit time with the increased propulsion speed 30 of the work vehicle 10.

The prime mover 16 includes or operates at a prime mover speed 44, or a rotational speed of the prime mover 16, such as measured in revolutions per minute (RPM) in a non-limiting example. The auxiliary work tool load threshold 28 depends on and/or is based at least partially on the prime mover speed 44. In non-limiting examples, the auxiliary work tool load threshold 28 is correlated, such as in a linear or exponential curve relationship as illustrated in FIG. 2, with the prime mover speed 44 such that the auxiliary work tool load threshold 28 increases when the prime mover speed 44 increases. In the work vehicle 10 and/or control system 200 illustrated in FIG. 2, the prime mover speed 44 is provided to the controller 22.

Referring again to FIG. 1, the work vehicle 10 of the illustrated embodiment includes a hydraulic circuit 20 connected to the auxiliary work tool 18. The hydraulic circuit 20 includes one or more hydraulic lines, pumps, motors, valves, and other hydraulic components (not shown) in one or more embodiments. In the illustrated embodiment, the prime mover 16 further drives, powers, or is otherwise connected to the auxiliary work tool 18 through the hydraulic circuit 20. In one or more additional embodiments, the prime mover 16 drives, powers, or is otherwise connected to the auxiliary work tool 18 with one or more mechanical, pneumatic, electrical, and/or other circuit(s) or means. In the illustrated embodiment, the hydraulic circuit 20 is connected to the auxiliary work tool 18 such that the auxiliary work tool load 34 is based on a hydraulic pressure of the hydraulic circuit 20. The work vehicle 10 of an embodiment includes one or more pressure sensors 46 configured to sense a hydraulic pressure within the hydraulic circuit 20.

In the illustrated embodiment, the hydraulic circuit 20 is further connected to the one or more ground engaging members 12 and/or another drivetrain component of the work vehicle 10 to provide motive power to the one or more ground engaging members 12 to allow movement of the work vehicle 10. In additional embodiments, another hydraulic circuit, electrical circuit, mechanical connection, and/or other energy transmission means is provided from the prime mover 16 to the ground engaging member(s) 12 to allow movement of the work vehicle 10.

In any one or more embodiments, the prime mover 16 supplies torque or other force directly or indirectly to both the auxiliary work tool 18 and the ground engaging member(s) 12. Therefore, for a given propulsion speed 30 of the work vehicle 10 and the prime mover speed 44, the auxiliary work tool load threshold 28 exists for the auxiliary work tool load 34 such that, for any applied loads above the threshold 28, the auxiliary work tool 18 may slow, stall, or otherwise perform undesirably if no further action is taken. As described in further detail below, reducing the propulsion speed 30 of the work vehicle 10 prevents, minimizes, or reduces undesirable performance of the auxiliary work tool 18. In a further embodiment, increasing the prime mover speed 44 in addition to or in lieu of reducing the propulsion speed 30 of the work vehicle 10 also prevents, minimizes, or reduces undesirable performance of the auxiliary work tool 18.

The work vehicle 10 further includes the controller 22 configured to receive a propulsion input for propelling the work vehicle 10 via the ground engaging members 12 at the propulsion speed 30. The propulsion input includes a joystick and/or another operator control interface capable of receiving physical or other input from the operator or another source in one or more embodiments, and may include the output(s) from one or more circuit(s), controller(s), or other non-operator control interface(s) in additional embodiments.

As illustrated in FIG. 1, the work vehicle 10 of an embodiment further includes an operator interface 40 configured to generate one or more operator control input(s) 36.

In an embodiment, the propulsion input is based on one or more operator control input(s) 36, such as input to a joystick in a non-limiting example.

The controller 22 is further configured to receive an auxiliary work tool load input 26 based on the auxiliary work tool load 34. The pressure sensor(s) 46 are configured to sense the hydraulic pressure within the hydraulic circuit 20 and generate pressure signal(s) as the auxiliary work tool load input 26 communicated to the controller 22 to indicate the auxiliary work tool load 34 based on the hydraulic pressure of the hydraulic circuit 20. In additional embodiments, the auxiliary work tool load input 26 may be a torque sensor, strain gauge, voltage or other electrical value sensor, hydraulic pump load sensor, and/or another sensor, component, or device capable of determining a load. Further, in additional embodiments, the auxiliary work tool load input 26 includes sensed data from one or more sensors combined with additional vehicle, work tool, environmental, manual settings, and/or other input(s) received and/or processed by the controller 22.

In one or more embodiments, the controller 22 is further configured to reduce, increase, modulate, change, maintain, or otherwise control the propulsion speed 30 of the work vehicle 10. In the illustrated embodiment, the controller 22 is configured to reduce the propulsion speed 30 of the work vehicle 10 when the auxiliary work tool load 34 reaches or exceeds the auxiliary work tool load threshold 28. In one or more additional embodiments, the controller 22 is configured to reduce, increase, modulate, change, maintain, or otherwise control the prime mover speed 44 of the prime mover 16. In one or more embodiments, the controller 22 is configured to increase the prime mover speed 44 of the prime mover 16 when the auxiliary work tool load 34 reaches or exceeds the auxiliary work tool load threshold 28 in addition to or in lieu of reducing the propulsion speed 30 of the work vehicle 10.

In an embodiment, the work vehicle 10, the control system 200, and any associated methods includes a computer readable medium, such as the one or more memory circuit(s) 52 illustrated in FIG. 2, storing reference data associating the auxiliary work tool load threshold 28 with a plurality of prime mover speed values 60. The controller 22 determines the auxiliary work tool load threshold 28 using the reference data stored in the computer readable medium in an embodiment. In additional embodiments, the auxiliary work tool load threshold 28 may be determined in accordance with at least one algorithm, formula, or calculation based on the prime mover speed values. In a non-limiting example, the controller 22 receives the prime mover speed 44 and retrieves the auxiliary work tool load threshold 28 value from a look-up table having multiple load threshold values based on prime mover speed or applies an algorithm stored in the memory circuit 52 to determine the load threshold value based on the given prime mover speed 44.

The controller 22 is configured to reduce the propulsion speed 30 of the work vehicle 10 if the auxiliary work tool load input 26 exceeds an auxiliary work tool load threshold 28.

In an embodiment, the controller 22 is further configured to receive a desired propulsion speed input 42 for propelling the work vehicle 10 via the ground engaging members 12 at a desired propulsion speed 30. The propulsion speed input 42, in an embodiment, is based at least partially upon or originates from the propulsion input, so the propulsion speed input 42 may include an input associated with increasing, decreasing, or maintaining the propulsion speed 30 of the work vehicle 10. As used herein, the propulsion input and the propulsion speed input 42 may include the same or similar electronic, manual, or other control of the work vehicle 10, control system 200, or associated method(s) and, therefore, may be used interchangeably herein.

The controller 22 is further configured to reduce the propulsion speed 30 of the work vehicle 10 to a propulsion speed 30 under the desired propulsion speed 30 if the auxiliary work tool load input 26 exceeds the auxiliary work tool load threshold 28.

As shown in FIG. 2, in an embodiment, the controller 22 is further configured to receive a propulsion speed limit input 38 based on the operator control input 36 corresponding to a propulsion speed limit for propelling the work vehicle 10 via the ground engaging members 12 to a maximum propulsion speed 30. The controller 22 of the work vehicle 10 and/or control system 200 illustrated in FIG. 2 is further configured in an embodiment to determine, monitor, sense, or receive the propulsion speed 30 of the work vehicle 10. In an embodiment, the auxiliary work tool load threshold 28 is based further on the propulsion speed limit input 38.

The controller 22 is further configured to maintain the prime mover speed 44 of the prime mover 16, maintain the prime mover speed 44 at a constant prime mover speed 44, maintain the prime mover speed 44 at a prime mover speed 44 that is constant within 10% in an embodiment, or maintain the prime mover speed 44 at a prime mover speed 44 that is constant within 20% in several embodiments. The controller 22 in an embodiment is configured to maintain the prime mover speed 44 in accordance with these embodiments while reducing, increasing, modulating, changing, and/or otherwise controlling the propulsion speed 30 of the work vehicle 10, such as when the auxiliary work tool load 34 of the auxiliary work tool 18 exceeds the auxiliary work tool load threshold 28. In an embodiment, the controller 22, the work vehicle 10, the control system 200, and any associated method(s) maintain a constant auxiliary work tool load 34, or constant within 10% or another range in an embodiment, that is less than, at, or near the auxiliary work tool load threshold 28 by varying the propulsion speed 30 of the work vehicle 10.

Referring now to FIG. 3, a method 100 of controlling propulsion of the work vehicle 10 having the auxiliary work tool 18 is illustrated. The method 100 includes receiving, at step 110, the propulsion input for propelling the work vehicle 10 at the propulsion speed 30.

The method 100 further includes monitoring, sensing, receiving, or determining, at step 112, the prime mover speed 44 for the prime mover 16 configured to propel the work vehicle 10. The prime mover 16 of an embodiment provides the prime mover output based on the propulsion input.

The method 100 further includes propelling, at step 114, the work vehicle 10 with the prime mover output based on the propulsion input. The method 100 further includes operating, at step 116, the auxiliary work tool 18 while propelling the work vehicle 10. These propelling and operating steps include any structure, feature, or function of any embodiments of the work vehicle 10 and/or the control system 200 described herein.

The method 100 further includes monitoring, sensing, receiving, or determining, at step 118, the auxiliary work tool load 34 from operation of the auxiliary work tool 18, including, without limitation, any structure, feature, or function of any embodiments of the work vehicle 10 and/or the control system 200 described herein.

The method 100 further includes determining, at step 120, whether the auxiliary work tool load 34 of the auxiliary work tool 18 exceeds the auxiliary work tool load threshold 28. The auxiliary work tool load threshold 28 is at least partially based on the prime mover speed 44. In an embodiment, the method 100 includes storing reference data for the auxiliary work tool load threshold 28 based multiple prime mover speed values. The method 100 of an embodiment further includes determining the auxiliary work tool load threshold 28 using the reference data. In additional embodiments, the auxiliary work tool load threshold 28 may be determined in accordance with at least one algorithm, formula, or calculation based on the prime mover speed values. These determining, storing, and other related steps include any structure, feature, or function of any embodiments of the work vehicle 10 and/or the control system 200 described herein.

The method 100 further includes reducing, at step 122, the propulsion speed 30 of the work vehicle 10 if the auxiliary work tool load 34 of the auxiliary work tool 18 exceeds the auxiliary work tool load threshold 28. This reducing step includes any structure, feature, or function of any embodiments of the work vehicle 10 and/or the control system 200 described herein.

In an embodiment, the method 100 further includes receiving the propulsion speed limit input 38 corresponding to the propulsion speed limit for propelling the work vehicle 10 to the maximum propulsion speed 30. The method 100 in an embodiment further includes monitoring, sensing, receiving, or determining the propulsion speed 30 of the work vehicle 10. The auxiliary work tool load threshold 28 is based further on the propulsion speed limit input 38 in an embodiment. Determining the auxiliary work tool load 34 includes sensing the hydraulic pressure of the hydraulic circuit 20 connected to the auxiliary work tool 18 in an embodiment. The propulsion input of an embodiment is based on the operator control input 36. Operating the auxiliary work tool 18 while propelling the work vehicle 10 includes operating the auxiliary work tool 18 to receive the auxiliary work tool load 34 from working the ground under the work vehicle 10 while propelling the work vehicle 10 over the ground in an embodiment. Working the ground under the work vehicle 10 with regard to any embodiments of the work vehicle 10, the control system 200, or any associated methods may include digging, trenching, excavating, cultivating, tilling, moving, pulling, pushing, and/or otherwise performing work to, through, and/or in the ground or under the surface of the ground.

The method 100 of an embodiment further includes maintaining the prime mover speed 44 of the prime mover 16 if the auxiliary work tool load 34 of the auxiliary work tool 18 exceeds the auxiliary work tool load threshold 28. In one or more further embodiments, the method 100 further includes maintaining the prime mover speed 44 of the prime mover 16, while reducing, increasing, modulating, and/or changing the propulsion speed 30 of the work vehicle 10, if the auxiliary work tool load 34 of the auxiliary work tool 18 exceeds the auxiliary work tool load threshold 28. Any steps of any embodiment of the method 100 include any structure, feature, or function of any embodiments of the work vehicle 10 and/or the control system 200 described herein, and any embodiments of the work vehicle 10 and/or the control system 200 include any steps of any embodiments of the method 100.

The work vehicle 10, control system 200, and methods 100 of various embodiments described herein improve the operability and performance of the work machine 10. As the work vehicle 10 is subjected to the auxiliary work tool load 34, such load(s) may increase due to a density variation in the soil, presence of roots, rocks, or other objects or materials in the ground, and/or other ground variances. The auxiliary work tool load 34 is subject to a load from the work vehicle 10 traveling at the propulsion speed 30 across the ground. In order to prevent or reduce the likelihood of the auxiliary work tool 18 and/or the work vehicle becoming overloaded, stalling, or otherwise performing undesirably, the embodiments disclosed herein reduce the auxiliary work tool load 34 or otherwise adjust control of the work vehicle 10 to accommodate the increased load. The adjustment of one or more embodiments may improve operator control, fatigue, and/or comfort by automatically controlling propulsion, speed, or other operation of the work vehicle 10 based on the load(s) and may improve the performance and efficiency of the work vehicle 10 by preventing or reducing the likelihood of stalling or reduced performance of the auxiliary work tool 18 and/or the work vehicle 10.

As used herein, the term "module" or the term "controller" may be replaced with the term "circuit." The term "controller" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The controller may include one or more interface circuits. In some examples, the interface circuits may include wired or wireless interfaces that are connected to a local area network (LAN), the Internet, a wide area network (WAN), or combinations thereof. The functionality of any given controller of the present disclosure may be distributed among multiple controllers that are connected via interface circuits. For example, multiple controllers may allow load balancing. In a further example, a server (also known as remote, or cloud) controller may accomplish some functionality on behalf of a client controller.

The term code, as used above, may include software, firmware, and/or microcode, and may refer to programs, routines, functions, classes, data structures, and/or objects. The term shared processor circuit encompasses a single processor circuit that executes some or all code from multiple controllers. The term group processor circuit encompasses a processor circuit that, in combination with additional processor circuits, executes some or all code from one or more controllers. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple controllers. The term group memory circuit encompasses a memory circuit that, in combination with additional memories, stores some or all code from one or more controllers.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The work vehicle 10, the control system 200, the apparatuses, and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

As used herein, "e.g." is utilized to non-exhaustively list examples and carries the same meaning as alternative illustrative phrases such as "including," "including, but not limited to," and "including without limitation." As used herein, unless otherwise limited or modified, lists with elements that are separated by conjunctive terms (e.g., "and") and that are also preceded by the phrase "one or more of," "at least one of," "at least," or a like phrase, indicate configurations or arrangements that potentially include individual elements of the list, or any combination thereof. For example, "at least one of A, B, and C" and "one or more of A, B, and C" each indicate the possibility of only A, only B, only C, or any combination of two or more of A, B, and C (A and B; A and C; B and C; or A, B, and C). As used herein, the singular forms "a", "an" and "the" are intended to include the plural forms as well, unless the context clearly indicates otherwise. Further, "comprises," "includes," and like phrases are intended to specify the presence of stated features, steps, operations, elements, and/or components, but do not preclude the presence or addition of one or more other features, steps, operations, elements, components, and/or groups thereof. None of the elements recited in the claims are intended to be a means-plus-function element within the meaning of 35 U.S.C. § 112(f) unless an element is expressly recited using the phrase "means for," or in the case of a method claim using the phrases "operation for" or "step for."

While the present disclosure has been illustrated and described in detail in the drawings and foregoing description, such illustration and description is not restrictive in character, it being understood that illustrative embodiment(s) have been shown and described and that all changes and modifications that come within the spirit of the present disclosure are desired to be protected. Alternative embodiments of the present disclosure may not include all of the features described yet still benefit from at least some of the advantages of such features. Those of ordinary skill in the art may devise their own implementations that incorporate one or more of the features of the present disclosure and fall within the spirit and scope of the appended claims.

What is claimed is:

1. A method of controlling propulsion of a work vehicle having an auxiliary work tool, the method comprising:

receiving a propulsion input for propelling the work vehicle at a propulsion speed;

determining a prime mover speed for a prime mover configured to propel the work vehicle, the prime mover providing a prime mover output based on the propulsion input;

propelling the work vehicle with the prime mover output based on the propulsion input;

operating the auxiliary work tool while propelling the work vehicle;

determining an auxiliary work tool load from operation of the auxiliary work tool;

determining whether the auxiliary work tool load of the auxiliary work tool exceeds an auxiliary work tool load threshold, wherein the auxiliary work tool load threshold is based on the prime mover speed; and reducing the propulsion speed of the work vehicle if the auxiliary work tool load of the auxiliary work tool exceeds the auxiliary work tool load threshold;

wherein operating the auxiliary work tool while propelling the work vehicle comprises operating the auxiliary work tool to receive the auxiliary work tool load from working a ground under the work vehicle while propelling the work vehicle over the ground.

2. The method of claim 1, further comprising:

receiving a propulsion speed limit input corresponding to a propulsion speed limit for propelling the work vehicle to a maximum propulsion speed; and determining the propulsion speed of the work vehicle, wherein the auxiliary work tool load threshold is based further on the propulsion speed limit input.

3. The method of claim 1, further comprising:

storing reference data for the auxiliary work tool load threshold based a plurality of prime mover speed values; and determining the auxiliary work tool load threshold using the reference data.

4. The method of claim 1, wherein determining the auxiliary work tool load comprises sensing a hydraulic pressure of a hydraulic circuit connected to the auxiliary work tool.

5. The method of claim 1, wherein the propulsion input is based on an operator control input.

6. The method of claim 1, further comprising maintaining the prime mover speed of the prime mover if the auxiliary work tool load of the auxiliary work tool exceeds the auxiliary work tool load threshold.

7. A work vehicle comprising:

a plurality of ground engaging members configured to propel the work vehicle at a propulsion speed;

a prime mover configured to drive the plurality of ground engaging members based on a prime mover output;

an auxiliary work tool receiving an auxiliary work tool load that is based on the propulsion speed of the work vehicle;

a controller configured to receive a propulsion input for propelling the work vehicle via the plurality of ground engaging members at the propulsion speed, receive an auxiliary work tool load input based on the auxiliary work tool load, and reduce the propulsion speed of the work vehicle if the auxiliary work tool load input exceeds an auxiliary work tool load threshold;

wherein the auxiliary work tool is configured to receive the auxiliary work tool load from working a ground under the work vehicle while the plurality of ground engaging members are propelling the work vehicle over the ground.

8. The work vehicle of claim 7, further comprising an operator interface configured to generate an operator control input, wherein the controller is further configured to:

receive a propulsion speed limit input based on the operator control input corresponding to a propulsion speed limit for propelling the work vehicle via the plurality of ground engaging members to a maximum propulsion speed; and determine the propulsion speed of the work vehicle, wherein the auxiliary work tool load threshold is based further on the propulsion speed limit input.

9. The work vehicle of claim 7, wherein the controller is configured to:

receive a desired propulsion speed input for propelling the work vehicle via the plurality of ground engaging members at a desired propulsion speed; and reduce the propulsion speed of the work vehicle to a propulsion speed under the desired propulsion speed if the auxiliary work tool load input exceeds the auxiliary work tool load threshold.

10. The work vehicle of claim 7, further comprising a non-transitory computer readable medium storing reference data associating the auxiliary work tool load threshold with a plurality of prime mover speed values, wherein the controller determines the auxiliary work tool load threshold using the reference data stored in the non-transitory computer readable medium.

11. The work vehicle of claim 7, further comprising a hydraulic circuit connected to the auxiliary work tool, wherein the auxiliary work tool load is based on a hydraulic pressure of the hydraulic circuit.

12. The work vehicle of claim 7, wherein the propulsion input is based on at least one operator control input.

13. The work vehicle of claim 7, wherein the prime mover comprises a prime mover speed, and wherein the auxiliary work tool load threshold is based on the prime mover speed.

14. The work vehicle of claim 13, wherein the controller is further configured to maintain the prime mover speed of the prime mover if the auxiliary work tool load of the auxiliary work tool exceeds the auxiliary work tool load threshold.

* * * * *